US009834426B2

(12) United States Patent
Bhalerao et al.

(10) Patent No.: US 9,834,426 B2
(45) Date of Patent: Dec. 5, 2017

(54) MIXING NOZZLE

(71) Applicant: NESTEC S.A., Vevey (CH)

(72) Inventors: Amol Ashok Bhalerao, Dublin, OH (US); David J. Harrison, New Milford, CT (US); Joshua Headings, Plain City, OH (US); Robert Mora, Worthington, OH (US); Balakrishna Reddy, Dublin, OH (US)

(73) Assignee: Nestec S.A., Vevey (CH)

( * ) Notice: Subject to any disclaimer, the term of this patent is extended or adjusted under 35 U.S.C. 154(b) by 25 days.

(21) Appl. No.: 14/895,593

(22) PCT Filed: Jun. 3, 2013

(86) PCT No.: PCT/US2013/043885
§ 371 (c)(1),
(2) Date: Dec. 3, 2015

(87) PCT Pub. No.: WO2014/196951
PCT Pub. Date: Dec. 11, 2014

(65) Prior Publication Data

US 2016/0130126 A1 May 12, 2016

(51) Int. Cl.
*B67D 1/00* (2006.01)

(52) U.S. Cl.
CPC ..... *B67D 1/005* (2013.01); *B67D 1/0021* (2013.01); *B67D 1/0043* (2013.01); *B67D 1/0078* (2013.01); *B67D 1/0081* (2013.01)

(58) Field of Classification Search
CPC .... B67D 1/005; B67D 1/0021; B67D 1/0043; B67D 1/0078
USPC ..... 239/10
See application file for complete search history.

(56) References Cited

U.S. PATENT DOCUMENTS 4,808,346 A * 2/1989 Strenger ..... A47J 31/407 222/129.1
4,922,810 A * 5/1990 Siccardi ..... A47J 31/4485 261/DIG. 16
5,000,351 A 3/1991 Rudick
(Continued)

FOREIGN PATENT DOCUMENTS

AU 2013205067 5/2013
GB 1202040 8/1970

*Primary Examiner* — Chee-Chong Lee
(74) *Attorney, Agent, or Firm* — K&L Gates LLP

(57) ABSTRACT

A mixing nozzle (1) for mixing a concentrate and a diluent and dispensing the mixture is disclosed. The mixing nozzle includes: a concentrate conduit including a concentrate inlet port (2) and a concentrate outlet port (3) and a concentrate flowpath (4) therebetween, the conduit defining the longitudinal axis (XX') of the mixing nozzle; a toroidal chamber (5) around said concentrate conduit having a water inlet conduit (6) tangentially disposed with respect thereto to create a swirling of the water in said chamber, said toroidal chamber presenting multiple openings (7) at the bottom wall of the toroidal chamber to create multiple flows of diluent around the concentrate outlet port (3); an assembly of multiple radially projecting ribs (10) provided downstream to the multiple openings (7) of the toroidal chamber, the ribs being curved at their downstream ends (10*a*) towards the mixing nozzle longitudinal axis (XX').

13 Claims, 6 Drawing Sheets

(56) References Cited

U.S. PATENT DOCUMENTS

| | | | | | |
|---|---|---|---|---|---|
| 5,570,822 | A * | 11/1996 | LeMarbe | B67D 1/0027 | 222/129.1 |
| 5,938,327 | A * | 8/1999 | Benskin | B01F 5/0256 | 366/137.1 |
| 5,980,969 | A * | 11/1999 | Mordini | A23F 3/163 | 426/435 |
| 6,305,269 | B1 * | 10/2001 | Stratton | B67D 1/0044 | 222/459 |
| 6,871,761 | B2 * | 3/2005 | Fox | B67D 1/0021 | 222/129.1 |
| 2005/0082313 | A1 | 4/2005 | Fox | | |

* cited by examiner

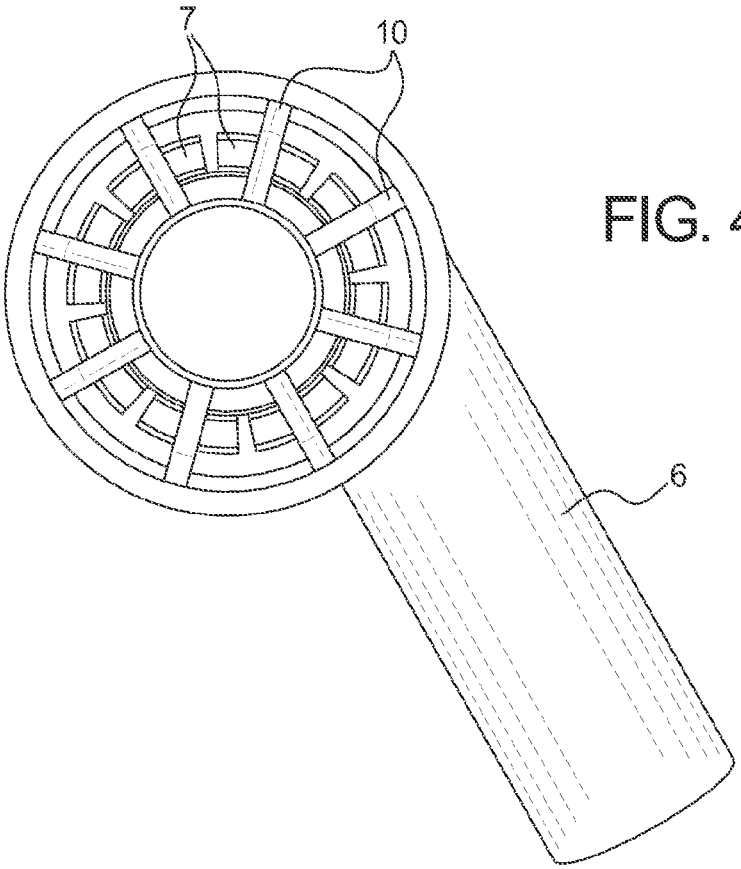
FIG. 4
FIG. 5
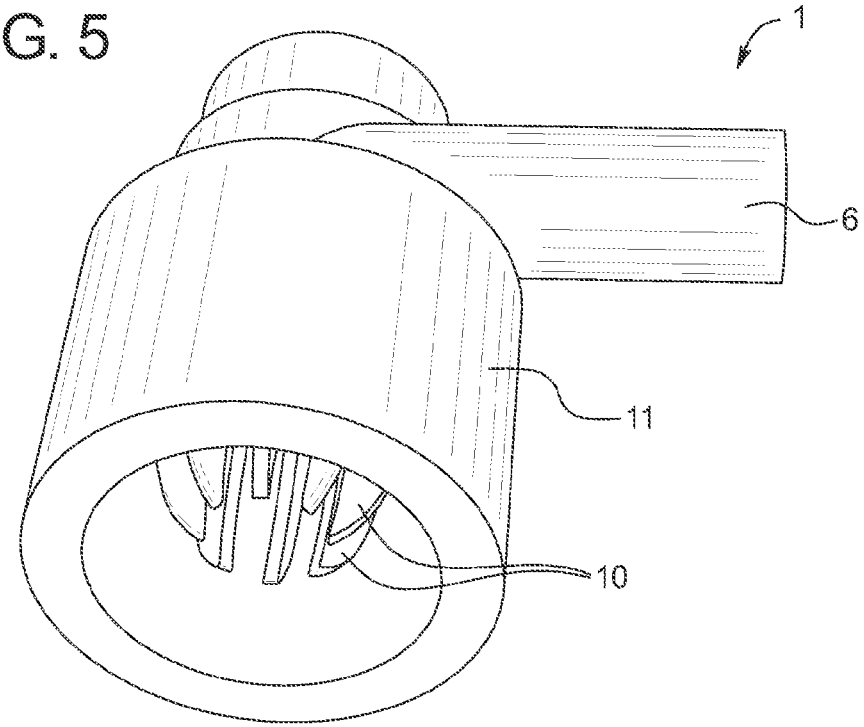

MIXING NOZZLE

CROSS REFERENCE TO RELATED APPLICATIONS

The present application is a National Stage of International Application No. PCT/US2013/043885, filed on Jun. 3, 2013, the entire contents of which are being incorporated herein by reference.

FIELD OF THE INVENTION

The present disclosure generally relates to beverage dispensing devices. More specifically, the present disclosure relates to mixing nozzle fitments for dispensing beverages.

BACKGROUND OF THE INVENTION

There are a variety of beverage dispensers currently on the market. Some beverage dispensers operate by dispensing a hot or cold ready-to-drink fluid directly into a container such as a cup. Other beverage dispensers operate by dispensing a powdered or liquid concentrate along with a separate diluent through a beverage dispensing nozzle and into a container or cup to form the drink.

The present invention relates to post-mix dispensers in which a liquid concentrate is stored and is automatically combined at the time of dispensing with a diluent such as water. The combination is usually operated in a mixing chamber in which the concentrate and the diluent emerge. The relative flows of the concentrate and diluent can be controlled to maximize the qualities of the beverage such as mixing and foam production. This mixing chamber can be a mixing tee fitment such as described in WO 2010115888. This mixing tee fitment cooperates with the end of a flexible tube attached to a concentrate container. The concentrate can be pumped through the flexible tube by peristaltic pump as well known in the state of the art. In the mixing tee fitment a flow of water mixes with a dose of concentrate. It has been observed that for concentrates presenting high viscosity properties the mixing and dilution with water can be difficult. Then the beverage in the drinking cup may not be homogeneous.

SUMMARY OF THE INVENTION

According to a first aspect, the invention concerns a mixing nozzle for mixing a concentrate and a diluent and dispensing the mixture comprising:

- a concentrate conduit including a concentrate inlet port and a concentrate outlet port and a concentrate flowpath therebetween, said conduit defining the longitudinal axis of the mixing nozzle,
- a toroidal chamber around said concentrate conduit having a water inlet conduit tangentially disposed with respect thereto to create a swirling of the water in said chamber, said toroidal chamber presenting multiple openings at the bottom wall of the toroidal chamber to create multiple flows of diluent around the concentrate outlet port,
- an assembly of multiple radially projecting ribs provided downstream to the multiple openings of the toroidal chamber, the ribs being curved at their downstream ends towards the mixing nozzle longitudinal axis.

According to a second aspect the invention concerns a device for dosing a concentrate, mixing the dosed concentrate with a diluent and dispensing the mixture comprising:

- a mixing nozzle such as described hereabove, and
- a pump.

According to a third aspect the invention concerns a package assembly comprising a concentrate container and a device for dosing a concentrate, mixing the dosed concentrate with a diluent and dispensing the mixture such as described hereabove.

According to a fourth aspect the invention concerns a method of making a beverage, the method comprising:

- providing a mixing nozzle such as described hereabove,
- dispensing portions of concentrate through the concentrate inlet port of the mixing nozzle and a diluent through the water inlet conduit of the mixing nozzle, the concentrate and the diluent being mixed and dispensed through the assembly of multiple radially projecting ribs to form the beverage.

The dependent claims further define the difference aspects of the invention.

BRIEF DESCRIPTION OF THE DRAWINGS

The characteristics and advantages of the invention will be better understood in relation to the following figures:

FIG. 4 is a bottom view of the mixing nozzle of FIG. 1, FIG. 5 is a view of the mixing nozzle of FIG. 1 with a shroud.

DETAILED DESCRIPTION OF THE DRAWINGS

Figure 1:
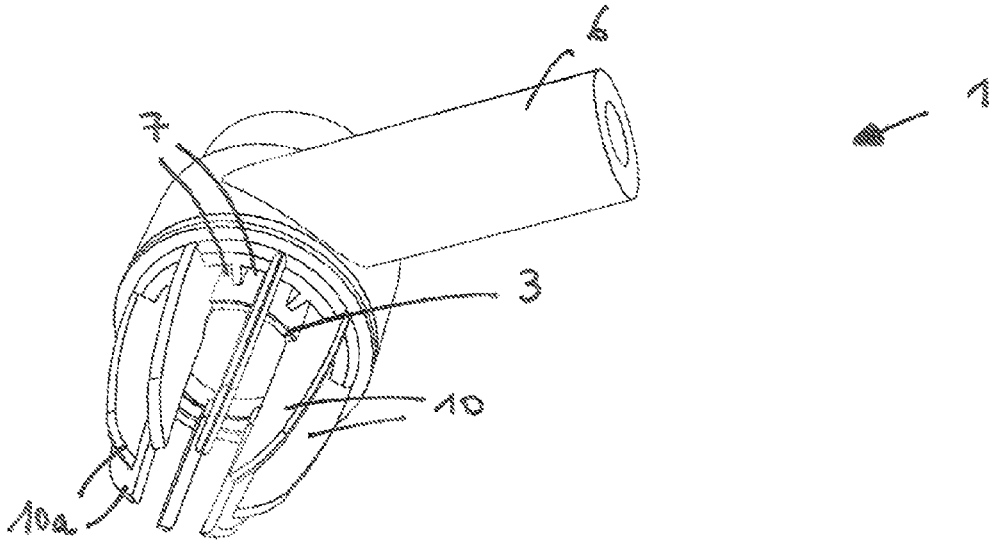
FIG. 1 is a perspective view of a mixing nozzle according to the invention.
Figure 2:
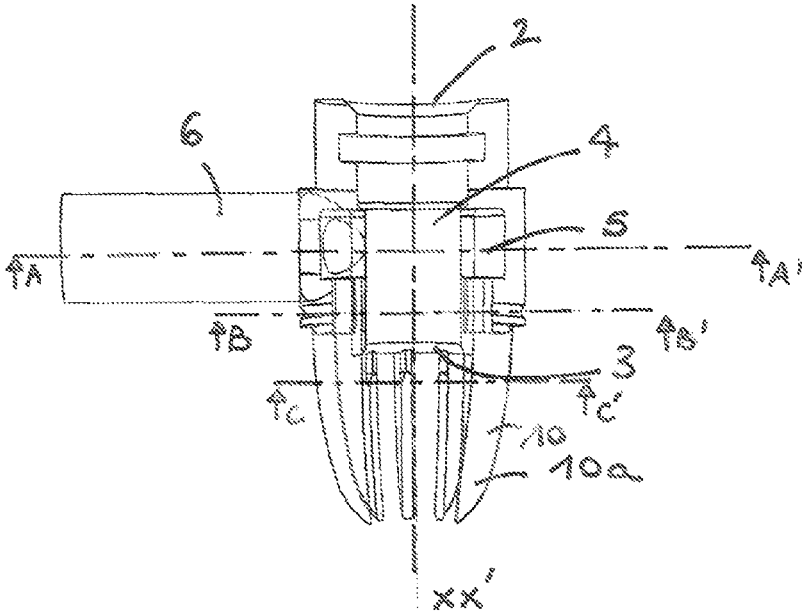
FIG. 2 is a longitudinal section view of the mixing nozzle of FIG. 1.

FIGS. 1 to 4 illustrates a mixing nozzle 1 for mixing a concentrate and a diluent and dispensing the mixture according to the invention. The mixing nozzle comprises a concentrate conduit including a concentrate inlet port 2 and a concentrate outlet port 3 and a concentrate flowpath 4 therebetween said conduit defining the longitudinal axis XX' of the mixing nozzle as illustrated in the longitudinal section view of FIG. 2. The nozzle comprises a toroidal chamber 5 around said concentrate conduit 6 having a water inlet conduit 6 tangentially disposed with respect thereto to create a swirling of the water in said chamber. The water inlet conduit 6 and the chamber 5 are particularly illustrated in FIG. 3*a* that is a transversal section of the mixing nozzle 1 at the level of said chamber 5.

Figure 3A:
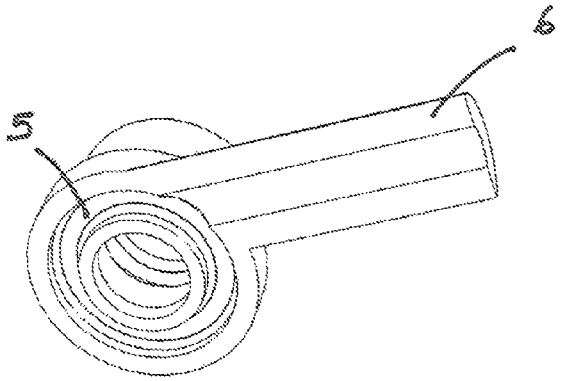
FIGS. 3*a*, 3*b*, 3*c* are transversal section views of the mixing nozzle of FIG. 1 according to sections AA', BB' and CC' as illustrated in FIG. 2.
Figure 3B:
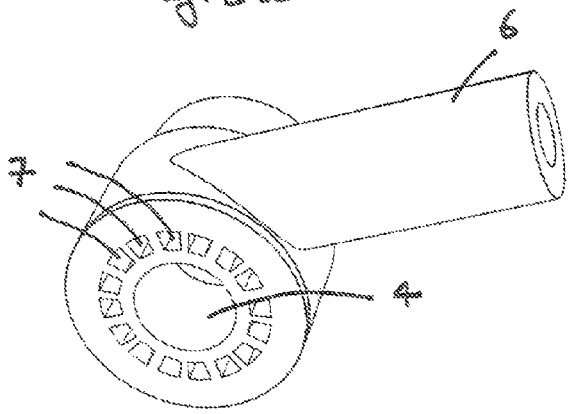
Figure 3C:
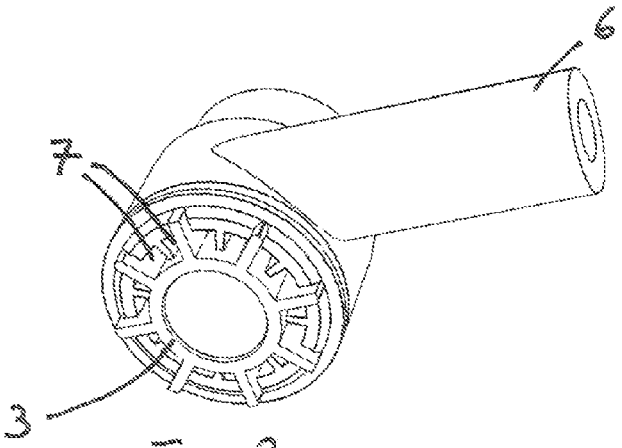

As illustrated in FIG. 3*b* that is a transversal section of the mixing nozzle 1 according to a section plane lower than in FIG. 3*a*, the toroidal chamber 5 presents multiple openings 7 at its bottom wall. These opening are preferably homogeneously distributed around the concentrate conduit. These openings 7 create multiple flows of diluent around the concentrate outlet port 3 as illustrated in FIG. 3*c* that is a lowest transversal section of the mixing nozzle.

The nozzle comprises an assembly of multiple radially projecting ribs 10 provided downstream to the multiple openings 7 of the toroidal chamber 5. These ribs are curved at their downstream ends 10*a* towards the mixing nozzle longitudinal axis XX'. The ribs provide large surface areas where the concentrate flowing from the concentrate outlet port 3 can spread; it increases the contact surface of the concentrate with water when the multiple water flows run on the ribs. The ribs also help in providing direction and streamlining the beverage mixture: they enable a better control of the dispensing of the beverage in the receptacle placed under the dispenser: the flow is directed to the centre of the nozzle and no splashing occurs around.

As illustrated the multiple radially projecting ribs 10 preferably do not extend downstream to the concentrate outlet port 3. This embodiment limits the deposit of concentrate on the ribs that could stick on them and then dried when no water is dispensed.

According to the illustrated embodiment at least two openings 7 of the toroidal chamber emerge in the space separating two ribs 10. Then flows of water can flow on each side of the ribs and improve mixing and then rinsing at the end of the beverage preparation.

As the mixing of the concentrate and the diluent occurs on the ribs the potential contaminations of the diluent inlet or the concentrate conduit outlet are limited.

According to the preferred embodiment illustrated in FIG. 5 the mixing 1 comprises a shroud 11. Preferably said shroud can be a cylindrical tube surrounding the assembly of multiple radially projecting ribs 10. This shroud aims at avoiding that an operator or a customer touches the nozzle.

Figure 6:
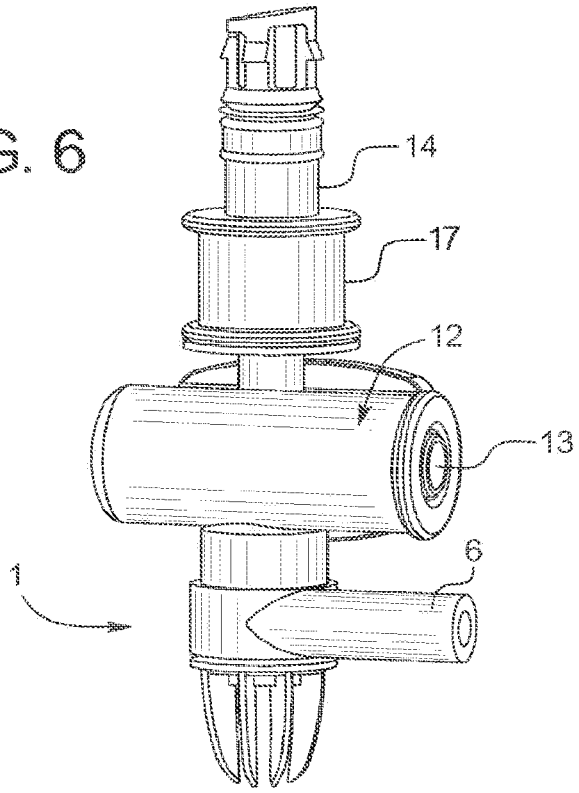
FIGS. 6 and 7 are assemblies of the mixing nozzle with a pump.

FIG. 6 illustrates an assembly of mixing nozzle according to the invention with a pump for dosing the concentrate. The mixing nozzle 1 presents the features of the mixing nozzle 1 of FIGS. 1 to 5. The concentrate inlet port 2 of the mixing nozzle is attached to a pump 12 of which inlet 17 can be attached to a beverage concentrate packaging through the fitment 14. The beverage concentrate can be a bag-in-box or a tetrabrik container. Consequently a dose of concentrate can be pumped by the pump 12 and be provided in the mixing nozzle concentrate conduit to be mixed with water introduced in the conduit 6 of the mixing nozzle. Preferably the pump 12 is a positive displacement pump and most preferably a rotary pump presenting a rotor interface 13 configured for being connected to a rotary shaft. The rotary pump is preferably of the type having a pump chamber containing a rotor which defines with the wall of the chamber at least one cavity extending around only a part of the chamber. Preferably the rotor interface 13 and the mixing nozzle water inlet conduit 6 are located on the same side of the device.

Figure 7:
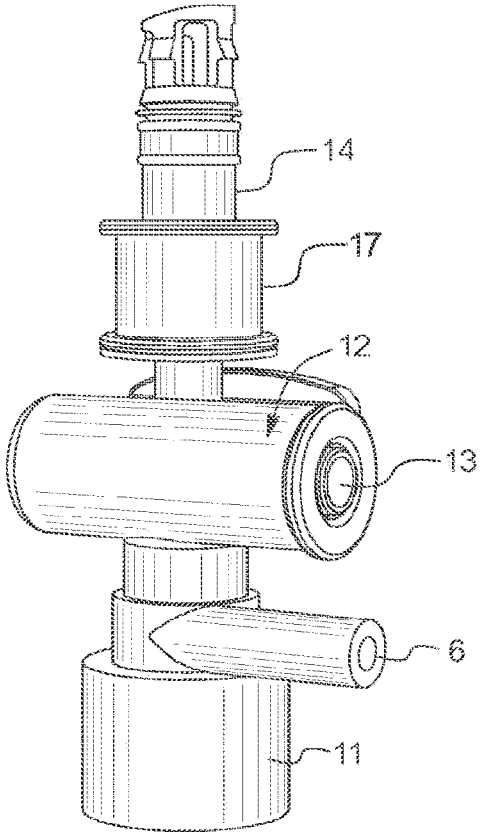

FIG. 7 illustrates the assembly of FIG. 6 wherein the mixing nozzle is surrounded by a cover 11.

Figure 8:
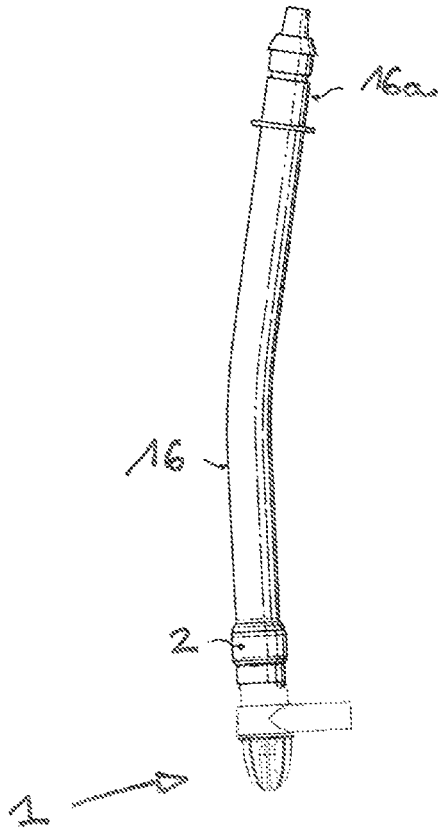
FIG. 8 is a view of the assembly of the mixing nozzle with a flexible tube.
Figure 9:
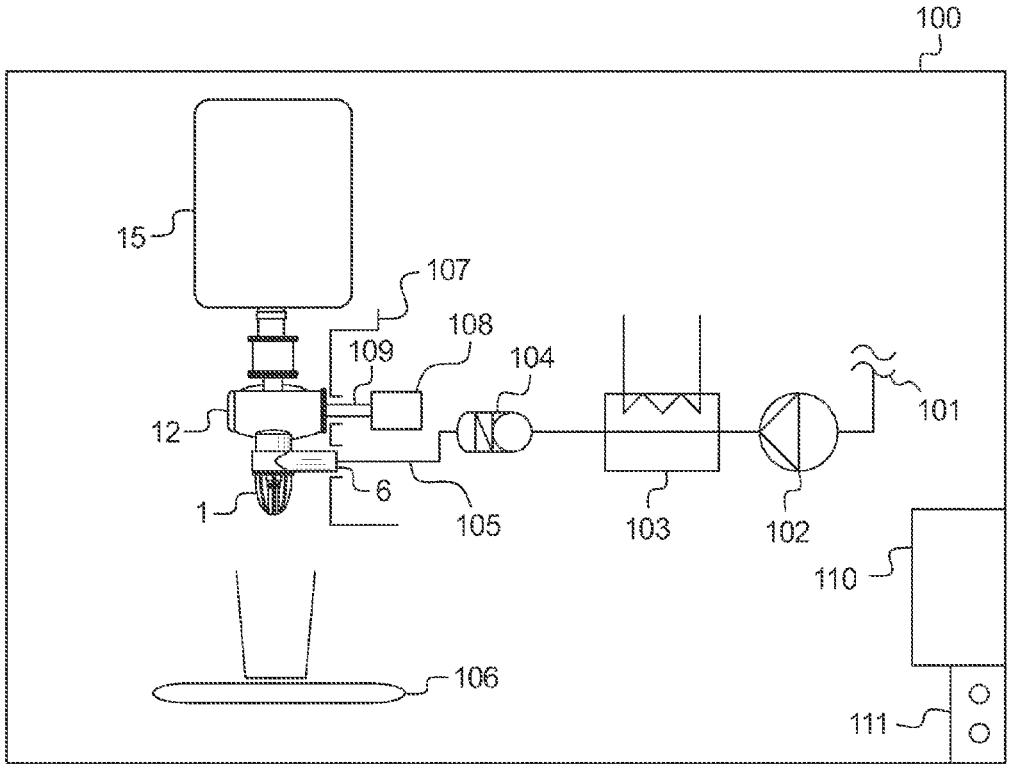
FIG. 9 is a schematic view of a beverage production machine comprising a mixing and dosing device according to the invention.

FIG. 8 illustrates a mixing a nozzle according to the invention in which a flexible tube 16 is attached to the concentrate inlet port 2 for example by stretching the end of the flexible tube around the part of the mixing nozzle through which the concentrate port extends. The other end of the flexible tube presents a fitment 16*a* for cooperating with a concentrate container. This embodiment enables the use of the mixing nozzle with a peristaltic pump that can urge the concentrate to flow through the flexible tube in direction of the nozzle.

According to the invention the mixing nozzle, the assembly of the mixing nozzle with the pump and the assembly of the mixing nozzle with the pump and the concentrate container can be made disposable.

Referring to FIG. 10, a beverage production machine 100 is represented that includes a package assembly comprising a beverage concentrate 15 attached to an assembly of mixing a nozzle 1 and a rotary pump 12 for dosing the concentrate such as described hereabove for producing a beverage from a beverage concentrate stored in the package assembly and a diluent entering the assembly.

A diluent feed circuit is provided in the machine to be able to feed the assembly with diluent, more particularly, water. For that, a water supply 101 is provided that can be tap water. A water pump 102 transports water from the supply 101 to a water heating or cooling unit 103 and to eventually a valve 104 that can open/close or adjust the flow. The water pump can be any type of pump such as a piston pump, diaphragm pump or a peristaltic pump. Finally water is fed into the water inlet conduit 6 of the mixing nozzle 1 by a tube 105. The machine also comprises a motor 108 to rotate a rotary shaft 109 configured for being connected to the interface 13 of the rotor of the pump 12 of the package assembly.

As illustrated in FIG. 10 the package assembly can be placed directly above a service tray 106 onto which is placed a drinking cup to receive the beverage liquid. The machine comprises a package assembly receiving area 107 to fix the assembly inside and provide cooperation between the water inlet conduit 6 and the machine diluent supply tube 105 and cooperation between the rotor interface of the rotary pump and the rotary shaft 109 of the motor 108. In an alternative mode the rotary shaft 109 can be replaced by a peristaltic pump and the package assembly can comprise a flexible tube in place of the rotary pump 12.

A controller 110 is provided to introduce water in the mixing nozzle 1 and coordinate dosing of the beverage concentrate by the pump 12 upon the user actuating or being prompted to press a command 111 on the machine. Preferably the controller is provided to rinse with water the mixing nozzle 1 at the end of the beverage preparation.

The invention claimed is:

1. A method of making a beverage, the method comprising:

providing a mixing nozzle for mixing a concentrate and a diluent and dispensing a mixture, the mixing nozzle comprising: a concentrate conduit including a concentrate inlet port, a concentrate outlet port, and a concentrate flowpath therebetween, the concentrate conduit defining a longitudinal axis of the mixing nozzle; a toroidal chamber around the concentrate conduit and having a diluent inlet conduit tangentially disposed with respect to the toroidal chamber to create a swirling of the diluent in the toroidal chamber, the toroidal chamber presenting multiple openings at a bottom wall of the toroidal chamber around the concentrate outlet port, and an assembly of multiple radially projecting ribs provided downstream to the multiple openings of the toroidal chamber, the multiple radially projecting ribs being curved at their downstream ends towards the longitudinal axis of the mixing nozzle;

dispensing portions of the concentrate through the concentrate inlet port of the mixing nozzle and the diluent through the diluent inlet conduit of the mixing nozzle; and mixing and dispensing the concentrate and the diluent through the assembly of multiple radially projecting ribs to form the beverage, the multiple openings creating multiple flows of the diluent around a flow of the concentrate flowing from the concentrate outlet port along the longitudinal axis of the concentrate conduit.

2. The method of claim 1 wherein the multiple radially projecting ribs do not extend into to the concentrate outlet port.

3. The method of claim 1 wherein at least two openings of the multiple openings of the toroidal chamber emerge in a space separating two of the multiple radially projecting ribs.

4. The method of claim 1 wherein the mixing nozzle comprises a shroud that is a cylindrical tube surrounding the assembly of multiple radially projecting ribs.

5. The method of claim 1 comprising directing the concentrate into the concentrate inlet port by directing the concentrate through a flexible tube attached to the concentrate inlet port.

6. The method of claim 1 wherein the mixing nozzle is part of a device comprising a pump.

7. The method of claim 6 wherein the pump is a rotary pump presenting a rotor interface connected to a rotary shaft, and the rotor interface and the water inlet conduit of the mixing nozzle are located on the same side of the device.

8. The method of claim 6 wherein the pump comprises a housing comprising a concentrate inlet that is connected to a fitment configured for fitting in a concentrate container.

9. The method of claim 8 wherein the device is part of a package assembly comprising the concentrate container.

10. The method of claim 9 comprising directing the concentrate from the concentrate container through a flexible tube connecting an outlet of the concentrate container and the concentrate conduit of the mixing nozzle.

11. The method of claim 1, wherein one or more of the multiple radially projecting ribs each extend from a wall separating two openings of the multiple openings of the toroidal chamber such that flows of the diluent through the two openings travel on each side of the one or more of the multiple radially projecting ribs.

12. The method of claim 1, wherein the concentrate outlet port is positioned downstream of the multiple openings of the toroidal chamber.

13. The method of claim 1, comprising mixing the concentrate and the diluent downstream to the multiple openings at the bottom of the toroidal chamber.

* * * * *